United States Patent [19]

Rockstead et al.

[11] 4,393,636

[45] Jul. 19, 1983

[54] BOX BEAM REINFORCED CONCRETE STRUCTURE

[76] Inventors: Raymond H. Rockstead; Christopher A. Rockstead, both of 10041 Tesla Rd., Livermore, Calif. 94550

[21] Appl. No.: 190,355

[22] Filed: Sep. 24, 1980

[51] Int. Cl.[3] ..... E04B 1/16

[52] U.S. Cl. ..... 52/381; 52/91; 52/576; 52/577

[58] Field of Search ..... 52/90, 91, 380–382, 52/454, 673, 675, 431, 383, 353, 576, 577

[56] References Cited

U.S. PATENT DOCUMENTS

| | | | |
|---|---|---|---|
| 1,585,430 | 5/1926 | Smith et al. | 52/576 |
| 1,815,492 | 7/1931 | Bradley | 52/127 |
| 1,839,496 | 1/1932 | Pawling | 52/673 |
| 1,887,668 | 11/1932 | Williams | 52/381 |
| 1,963,983 | 6/1934 | Garrett | 52/378 |
| 2,064,910 | 12/1936 | Harper | 52/91 |
| 2,113,875 | 4/1938 | Clark | 52/421 |
| 2,187,959 | 1/1940 | Williams | 52/381 |
| 2,262,899 | 11/1941 | Mechlin | 52/380 |
| 2,275,056 | 3/1942 | White | 52/383 |
| 3,305,991 | 2/1967 | Weissmann | 52/309 |
| 3,347,007 | 10/1967 | Hale | 52/378 |
| 3,407,560 | 10/1968 | Baumann | 52/648 |
| 3,559,355 | 2/1971 | Day | 52/383 |
| 4,052,829 | 10/1977 | Chapman | 52/454 |
| 4,104,842 | 8/1978 | Rockstead et al. | 52/650 |
| 4,253,288 | 3/1981 | Chun | 52/454 |

FOREIGN PATENT DOCUMENTS

| | | | |
|---|---|---|---|
| 461751 | 10/1968 | Switzerland | 52/431 |
| 779582 | 7/1957 | United Kingdom . | |
| 1478873 | 7/1977 | United Kingdom . | |

*Primary Examiner*—James L. Ridgill, Jr.

*Attorney, Agent, or Firm*—Manfred M. Warren; Robert B. Chickering; Glen R. Grunewald

[57] ABSTRACT

A box beam reinforced concrete and steel construction providing spaced apart wire mesh reinforced concrete skin walls and interior concrete supporting frangible sheets providing for solid concrete cores contiguous to and monolithically integrated with the skin walls.

3 Claims, 7 Drawing Figures

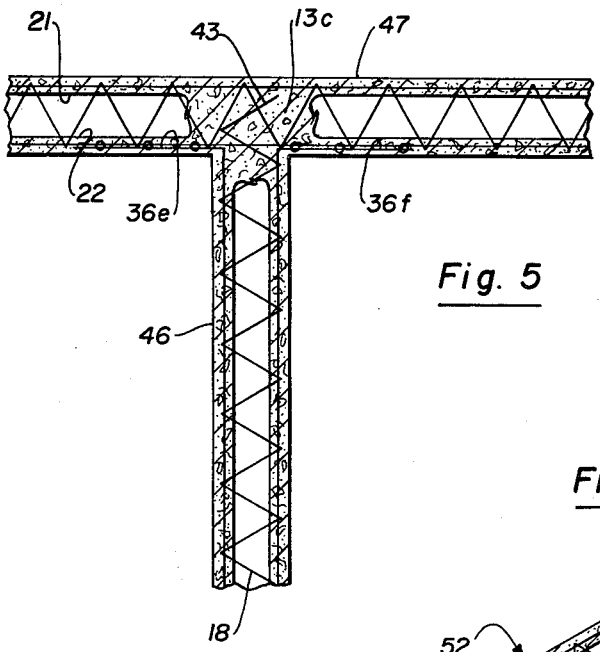
Fig. 5
Fig. 6
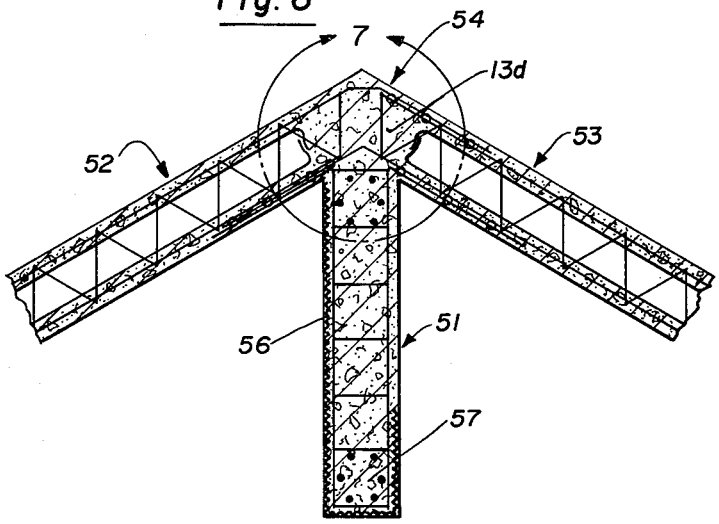
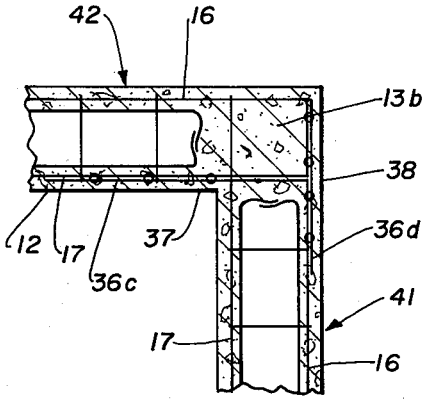
Fig. 4
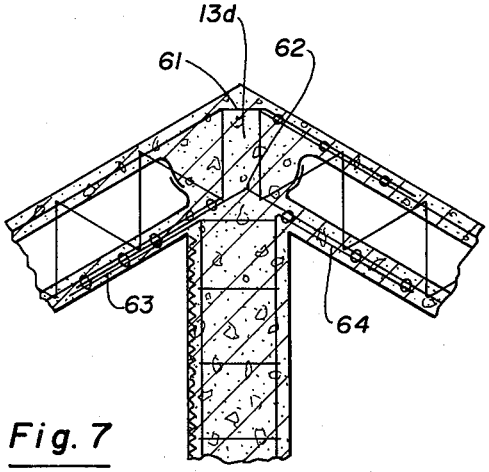
Fig. 7

BOX BEAM REINFORCED CONCRETE STRUCTURE

BACKGROUND OF THE INVENTION

1. Field of the Invention

The invention relates to reinforced concrete wall and building structures in which a box beam skeleton reinforcing matrix is first set in place and concrete or similar material is applied thereto, see, for example, U.S. Pat. Nos. 3,305,991 and 4,104,842. This application is a continuation-in-part of application Ser. No. 085,217, filed Oct. 16, 1979 for BOX BEAM BUILDING STRUCTURE.

2. Description of Prior Art

The structures disclosed in the above-noted U.S. Patents provide an excellent advance in the art, and are being used in the erection and construction of reinforced concrete building walls. Conventionally, the box beam matrix structure is fabricated and furnished to the job site in the form of modular panels, typically four feet wide and in standard lengths of eight feet, ten feet, twelve feet, etc., and, typically these panels are erected in a vertical plane on a foundation and hog-ringed or otherwise tied together in edge-to-edge abutment to define a continuous wall form. One or more interior partition walls are provided in the box beams which supply a backing for concrete applied to the opposite sides of the form to produce spaced apart concrete skins with the wire mesh sections of the box beams embedded therein as reinforcement. Typically, the concrete is applied by pressure spraying, a process commonly referred to as "guniting" or by hand lay-up techniques. One of the weaknesses of the structure is the lack of continuity of steel or wire mesh reinforcement throughout the joint between panels so as to make the entire wall structurally integral and the reinforcement continuous. Another disadvantage of the prior structures is the inability to provide for solid concrete wall sections at desired locations such as at joints between panels, at surrounds for door and window openings, at corners of the structure, at desired locations along the wall, and wherever concrete frame or load-bearing members are required.

Another disadvantage of prior art structures is the low diaphragm strength in resisting movement of the panel skins with respect to each other. Such movement causes shear and tensile failures due to the low tensile strength of concrete, requiring the steel carry-through especially across corners, panel joints, and in gripping trusses. Dependence on welds for such bonding is not totally reliable particularly with passage of time.

The inventors are familiar with the following prior art which constitutes the most pertinent art known to them and which serves to clearly illustrate the novelty of the present invention: U.S. Pat. Nos. 1,963,983; 2,275,056; 3,305,991; 3,347,007; 3,407,560; 3,559,355; 4,104,842; British Pat. No. 1,478,873.

SUMMARY OF THE INVENTION

An object of the present invention is to provide a modular building form and reinforcing matrix of the character described which may be quickly, easily, and precisely erected, followed by expeditious completion of finished concrete walls, and in which there will be provided at the joinder of the panels, a complete and effective reinforcing wire mesh matrix which will function to make integral and tied together the several panels forming walls, floors, ceilings, and other portions of the building.

Another object of the present invention is to provide a box beam reinforced concrete structure of the character described in which solid load-bearing wall sections or posts may be provided at desired locations and orientations along the walls, at joints between the panels, and at corners to thus afford most simply and effectively structural load-bearing capacity as desired and required.

A further object of the present invention is to provide a box beam building structure of the character described having a universality of application, enabling the panels to be erected vertically, e.g., to provide vertical walls; or horizontally, e.g., to provide floors or ceilings; or inclined, e.g., to provide roof sections and the like. The panels may be readily assembled in coplanar position or at acute, right, or obtuse angles. Moreover, panels may be connected together to provide a large number of new, important building structures including:

a. The combination of a wall section and a vertically extending post;
b. The combination of a wall section and a horizontally extending beam;
c. The combination of a horizontal wall section providing a floor or ceiling and an integrally connected horizontally extending beam; and
d. The combination of a pair of roof sections mounted to provide the intersecting sides of a roof peak, and an integral roof beam extending horizontally at the interior side of the peak.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

BRIEF DESCRIPTION OF THE DRAWINGS

FIG. 4 is an enlarged fragmentary detail of a portion of the wall indicated by the circled area 4 in FIG. 2.

FIG. 5 is a fragmentary cross-sectional view of another building portion constructed in accordance with the present invention.

FIG. 6 is a fragmentary cross-sectional view of still another building portion constructed in accordance with the present invention.

FIG. 7 is an enlarged cross-sectional view of the structure indicated by the circled area 7 in FIG. 6.

DETAILED DESCRIPTION OF THE INVENTION

Figure 2:
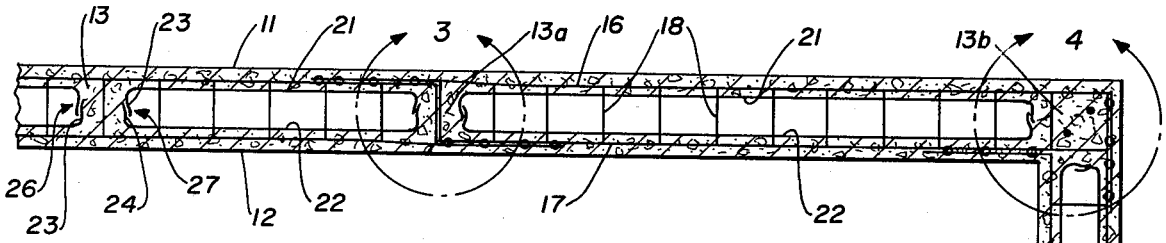
FIG. 2 is a cross-sectional view of the wall of FIG. 1, taken substantially on the plane of line 2—2 of FIG. 1.

The structure of the present invention provides integrated concrete skin walls 11 and 12 and solid concrete cores 13, 13*a*, and 13*b*, see FIG. 2 in box beam reinforced concrete and steel construction. The box beam typically has a pair of wire mesh sections 16 and 17 and a plurality of sinuous truss wires 18 extending between and having their apexes fixed to and supporting the sections in spaced apart substantially parallel planes, see Rockstead and Fahrenbach U.S. Pat. No. 4,104,842. Mounted on the truss wires interiorly of and substantially parallel to the wire mesh sections 16 and 17 are flexible, frangible sheets 21 and 22, such as building paper, and which serve as backing for concrete applied to the box beam, preferably by pressure spraying of the concrete in the process commonly referred to as "gunniting." The concrete builds up from the paper sheets 21 and 22 outwardly so as to encase the wire mesh sections 16 and 17 and the apexes of the truss wires so that the latter become embedded medially within the concrete skin walls thus formed and as steel reinforcement thereof. As a feature of the present invention, paper sheets 21 and 22 have sheet ends 23 and 24 folded transversely and interiorly to form spaced apart backing walls 26 and 27 for concrete forming the solid concrete core 13, which, importantly, is contiguous to and monolithically integrated with the concrete skin walls 11 and 12.

The box beams are, in the main, fabricated in modular sizes of typically four feet in width and eight, ten, twelve feet in length. The wire mesh sections have longitudinally extending wires 31 and transversely extending wires 30, and the truss wires 18 have their apexes secured to the longitudinally extending wires, see U.S. Pat. No. 4,104,842. In accordance with the present invention, the solid concrete cores 13 may be formed by cutting and folding of the paper at any desired location along the length of a wall, as surrounds for window and door openings, at joints between panels, at corners of the structure, wherever such load bearing capacity is desired or required. Where the solid core is formed medially of the width of the panel, as illustrated by solid core 13 in FIGS. 1 and 2, the frangible sheets 21 and 22 are severed, as with a knife, so as to provide the end portions 23 and 24 which may be folded interiorly and overlapped to provide the spaced apart concrete supporting walls 26 and 27, as depicted in FIG. 2. The cut may be made vertically, horizontally, curved or straight. As the concrete is applied to the paper to form the concrete skin walls, the operator will direct concrete onto the transverse walls 26 and 27 and fill the space between walls 26 and 27 at the same time as building up the contiguous concrete skin walls so that the skin walls and solid core 13 will be formed as a unitary monolithic mass. Core 13 forms a vertical post in the structure illustrated. However, the solid core may be fashioned as a diagonal brace, as a square or circle, surround for doors, windows, etc., or as a curved arch. One or more lengths of reinforcing steel may be included in core 13 as required. Solid cores **13*a* and 13*b*** are formed adjacent the normal edges of the paper sheets so that no cutting of the sheets is required. The edge portions of the sheets are simply folded inwardly and overlapped as illustrated in the drawings, the extent of folding back of the sheet edges determining the dimension of the solid core being formed.

The solid concrete core may be monolithically molded around the periphery of the panels to the concrete skins thereby restraining the latter from motion in any and all directions from the corners, joints and free edges of the panel. This structure prevents relative motion of the skins with respect to each other within the limits of the strength of the materials, and thereby creates a box beam of superior flexural strength, lightness in weight, and rigidity, with maximum economy in the use of materials. The present structure is, accordingly, also highly resistant to earthquake damage.

Figure 1:
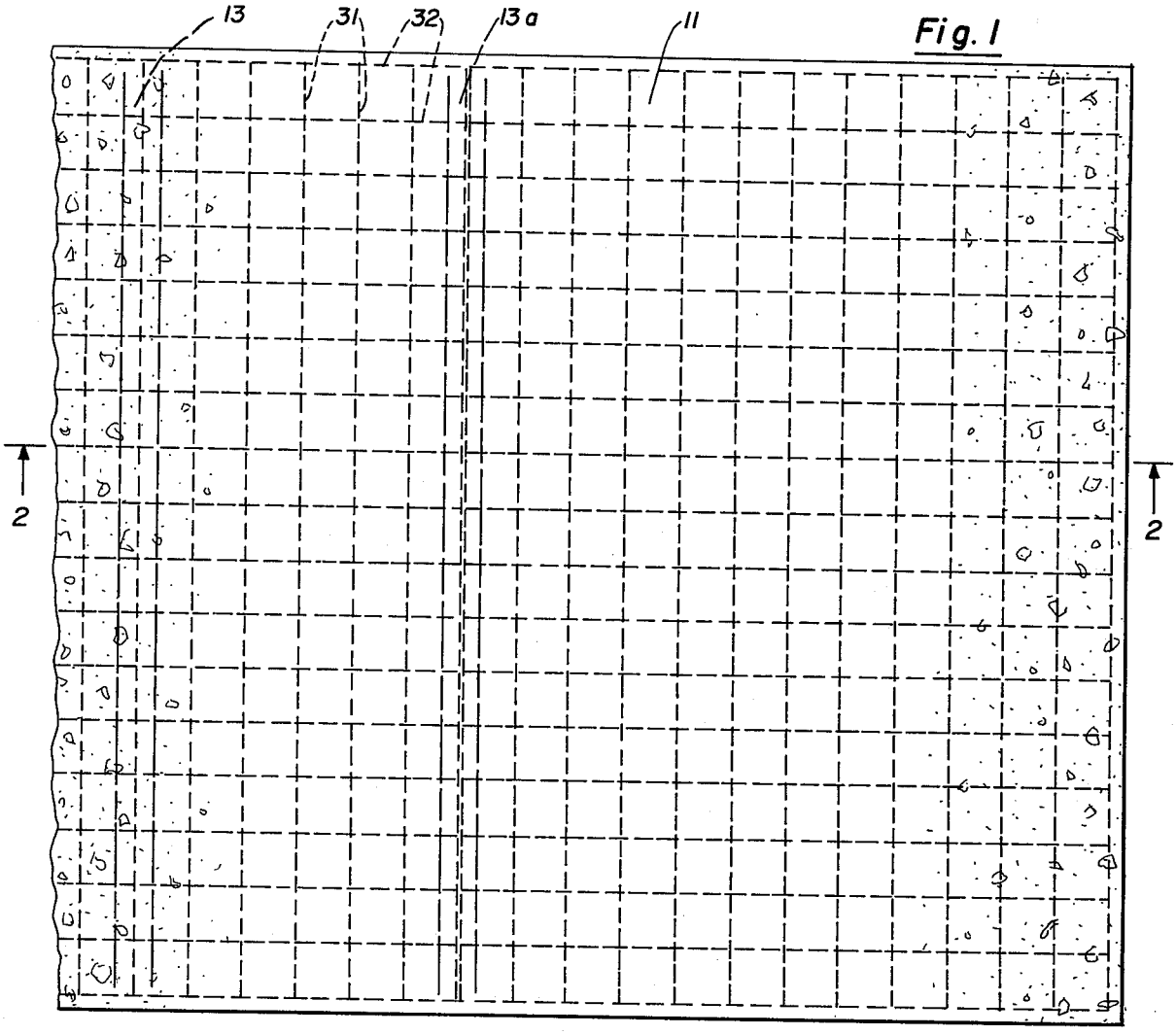
FIG. 1 is a front elevational view of a building wall constructed in accordance with the present invention.
Figure 3:
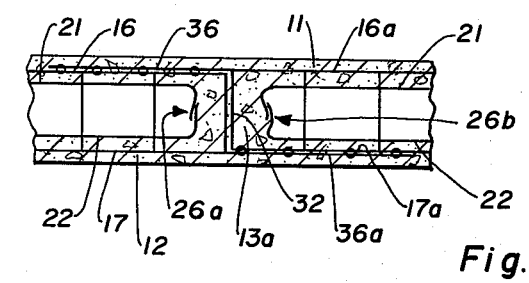
FIG. 3 is an enlarged fragmentary detail of a portion of the wall indicated by the circled area 3 of FIG. 2.

One of the important features of the present invention is the ability to integrate the solid core into a joint between two of the box beam sections, see, for example, joints **13*a* and 13*b*, illustrated in FIGS. 2, 3 and 4. A similar use of the solid core is also incorporated in the structures illustrated in FIGS. 5, 6 and 7. In the case of edge-to-edge panels, as illustrated in FIGS. 1 and 2, the edge portions of sheets 21 and 22 are folded back and interiorly and into overlapping relation, as seen in FIGS. 2 and 3 to define spaced apart walls 26*a* and 26*b* on opposite sides of and spaced from the edge-to-edge abutment 32 of two box beam panels. The side edge of each panel is normally defined by a longitudinally extending truss wire and, accordingly, two such truss wires are brought into abutment or close positioning in the erection of the box beams. Accordingly, the two edge truss wires of the two box beams will be buried medially within the solid core 13*a* forming a solid post integrally joined to and forming a monolithic continuation of the concrete skin walls 11 and 12** of the two box beam sections.

As another important feature of the present construction, the truss wires of at least one of the box beams are terminated short of an edge portion of one of the wire mesh sections 16–17 at the joint between the two box beams so as to define a free-standing wire mesh extension or flange 36 which is positioned in overlapping relation to the adjacent wire mesh section 16–17 and monolithically incoporated in the joint. With reference to FIG. 3, it will be seen that wire mesh extension 36 of wire mesh section **16*a* is extended into overlapping relation onto wire mesh section 16 and is, preferably, fastened as by hog-rings thereto. Accordingly, in the forming of the concrete skin wall 11 there is a continuous wire mesh reinforcement across the edge-to-edge abutment of the box beam panels. In a similar fashion, a free-standing wire mesh extension 36*a* is formed as a continuation of wire mesh section 17 so as to overly and be secured to wire mesh section 17*a* of the adjacent box beam. Thus, in the monolithic forming of concrete skin wall 12 and core 13*a*, there will be a continuous wire mesh reinforcement across the edge-to-edge abutment 32** on both sides of the abutment.

Another important feature of the present construction is the ability to place the solid concrete core within the corner defined by intersecting box beams as, for example, illustrated in FIGS. 2, 4, 5, 6 and 7. Solid core **13*b*, FIGS. 2 and 4, is located at an outside corner of the building structure, the corner having inside and outside surfaces 37 and 38. Preferably, and as here shown, wire mesh extensions 36*c* and 36*d* are provided on two of the wire mesh sections so as to reinforce the corner adjacent its inside and outside surfaces. As here shown, extension 36*c* is formed as a continuation of wire mesh section 17 of box beam 41 and is bent laterally to underly wire mesh section 17 of box beam 42 and is monolithically cast within the concrete skin wall 12 at the inside corner of the joint. Extension 36*d* is provided on the wire mesh section 16 of box beam 42 and is folded around the outside of the corner to overly and be attached to wire mesh section 16 of box beam 41 so that the overlapping mesh sections are monolithically cast in the joint adjacent the outside corner surface 38. The mesh extensions 36*c* and 36*d*** may be attached in any convenient manner as by hog-rings.

Applicants have perfected the production of the box beams at the job site enabling customizing of individual panels as to size and the provision for and length of the free-standing wire mesh extensions. Similarly, the wire mesh sections may be terminated short of the longitudinally extending truss wires 18 so as to provide an extension 43 of the truss wires from one end of a panel for casting within the solid concrete core provided at an intersecting joint of the panels. Such a construction is illustrated in FIG. 5 wherein wall 46 intersects wall 47. As here shown, the paper sheets 21 and 22 of the box beam forming wall 47 are severed and folded back adjacent the intersection of the walls to provide a solid core 13*c* similar in character to core 13 hereinabove described in connection with the showing of FIG. 2. The truss extensions 43 of the box beam panel forming wall 46 are positioned within the opening formed by folding back of the paper portions in wall 47 so that these truss ends are monolithically cast within the solid core 13*c*. Preferably, free-standing wire mesh extensions 36*e* and 36*f* are provided at the intersecting end of the box beam forming wall 46 and these extensions are bent laterally to underly and be attached to the adjacent wire mesh section of the box beam forming wall 47 so as to be monolithically cast into the concrete skin wall and the solid concrete core 13*c*.

FIGS. 6 and 7 illustrate a structural configuration wherein one box beam 51 has a generally depending vertical orientation providing a beam support for one or more box beams, as for example, two box beams 52 and 53 having an upward conversion defining a roof peak 54. In this case, the paper sheets of box beams 52 and 53 are folded back adjacent their intersecting ends so as to provide a solid concrete core 13*d* similar in nature to core 13*a* provided between contiguous box beams in FIG. 3, and box beam 51 is filled solid with concrete for maximum beam strength. As here shown, a perforate metal sheet 56 is attached to one side of box beam 51 so as to form a backing for concrete, and is extended around the bottom of the beam to define an open-top cup 57 for supporting concrete emplaced therein. The operator will spray concrete into cup 57 and against the adjacent side of sheet 56, building up the concrete mass until the box beam is filled out to completely encase the wire mesh sections. The concrete placed in the box beam 51 and in the joint 13*d* between the intersecting box beams is emplaced at the same time so as to provide a monolithic cast between the joint and beam. Preferably wire mesh extensions 61 and 62 are provided on the wire mesh sections of the box beams 52 and 53 as best illustrated in FIG. 7 so as to lap the adjacent ends of the box beam within the solid core section 13*d* and the integrated concrete skin walls. Additionally, wire mesh extensions 63 and 64 are provided at the upper end of box beam 51 and are bent laterally to return at the underside of the wire mesh sections of box beams 52 and 53 to thus add further steel reinforcement within the joint.

The box beam panels are preferably constructed from rolls of standard, commercially available rectangular wire mesh cloth. A two inch by four inch spacing of 12½ gauge steel wires is quite satisfactory for present purposes. The truss members may be composed of 12 gauge steel wire fabricated in a length to suit. A plurality of these trusses may be mounted in a jig making up the normal widthwise dimension of the panel, and the wire mesh cloth is positioned in spaced apart planes perpendicular to the truss members, with the latter spot-welded to the longitudinal wires of the mesh sections. Normally, a pair of truss members define the opposite longitudinal sides of the panel. In general, the wire mesh extensions or flanges transmit the stress of the concrete skin walls from one box beam to the adjacent one. Instead of being two separate individual rectangular plates of concrete, the wire mesh extensions establish one much stronger sheet of concrete virtually with an unbroken stress pattern. Accordingly, cracking along the joint will be resisted until very high, virtually catastrophic forces occur. In short, instead of concentrating displacement along a joint, the forces or stresses that will tend to cause the wall or other structure to come apart are distributed over the entire surface uniformly, thereby avoiding cracking and breaking.

The open wire mesh, as above-described, provides a number of important advantages. It is commercially available at modest costs, thereby providing a significant economy in the use of the overall system. It provides excellent spacing of the wires permitting easy movement of the concrete through the mesh for complete embedding of the mesh and the connected truss structure centrally within the concrete skin walls. It also provides an efficient use of steel reinforcement. Typically, under conventional practices, the minimum use of steel will represent at least about five percent of the concrete wall volume. In the present construction, this ratio is reduced to something less than one percent for comparable strength. Not only does applicants' wall provide all of the required strength of conventional walls using much higher amounts of steel reinforcement, but the small wire diameter and its distribution in the concrete provides far more uniformly distributed loads with far better crack control and significant economy in both steel and concrete.

The provision of the integrated monolithic corners and joints provide a means of resisting panel shear as above-noted and also provides a transmission of rotational moments to all parts of the building on a shared load basis, thereby resisting displacement across the integrated solid posts, corners, beams, etc. This is accomplished only in a totally structurally integrated building made possible by the system of the present invention which provides for the foregoing conveniently and with maximum efficiency and economy in the use of structural materials. Reinforcing rods may be incorporated in the solid core sections as required and illustrated in the drawings.

We claim:

1. The combination of integrated spaced apart parallel concrete skin walls and an elongated monolithic solid concrete core connecting said walls;

flexible wire mesh sections embedded in said walls and said core and being positioned to provide continuous reinforcement extending medially of said walls and across said core;

a plurality of sinuous truss wires each extending between and having its apexes fixed to and providing an uninterrupted continuous wire connection between and supporting said sections in spaced apart substantially parallel planes with said apexes embedded in said walls;

a pair of flexible frangible sheets mounted on and solely supported by said truss wires one interiorly of and substantially parallel to each of said sections in spaced relation thereto and providing backing for concrete forming said walls with said sections embedded medially in said walls;

said sheets permitting cutting thereof to provide selectively positioned sheet ends folded transversely and interiorly to form spaced apart backing walls on opposite sides of and generally parallel to one of said truss wires for supporting plastic concrete forming said core contiguous to and integrated with said skin walls; and said last-named truss wire extending through and being embedded in said core and having its length extending longitudinally of said core.

2. The combination of claim 1 comprising a plurality of box beams each having a pair of said wire mesh sections and a plurality of said sinuous truss wires and a pair of said flexible frangible sheets mounted on said truss wires;

said box beams being mounted in contiguous relation to form a joint;

said sheets having portions deployed transversely interiorally of said box beams to define the boundary of said joint and backing for concrete positioning said core in said joint integrally joined to and forming a monolithic continuation of said skin walls;

said truss wires being terminated short of an edge portion of one of said sections at said joint to define a free standing wire mesh extension overlapping and attached to the wire mesh section of a contiguous box beam and monolithically incorporated in one side of said joint; and said truss wires of another of said box beams being terminated short of an edge portion of one of said sections of said last name box beam at said joint to define a free standing wire mesh extension overlapping and attached to the wire mesh section of a contiguous box beam and monolithically incorporated in another side of said joint.

3. The structure of claim 2, said truss wires of one of said box beams projecting therefrom as free-standing wires extending into and being cast within said joint.

* * * * *